US011788167B2

(12) United States Patent
Zhang et al.

(10) Patent No.: US 11,788,167 B2
(45) Date of Patent: Oct. 17, 2023

(54) DEVICE AND METHOD FOR MANUFACTURING METAL CLAD STRIPS CONTINUOUSLY

(71) Applicant: BAOSHAN IRON & STEEL CO., LTD., Shanghai (CN)

(72) Inventors: Qingfeng Zhang, Shanghai (CN); Sihai Jiao, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 339 days.

(21) Appl. No.: 17/255,869

(22) PCT Filed: Jan. 14, 2019

(86) PCT No.: PCT/CN2019/071594
§ 371 (c)(1),
(2) Date: Dec. 23, 2020

(87) PCT Pub. No.: WO2020/001005
PCT Pub. Date: Jan. 2, 2020

(65) Prior Publication Data

US 2021/0262056 A1 Aug. 26, 2021

(30) Foreign Application Priority Data

Jun. 29, 2018 (CN) ..... 201810702004.2

(51) Int. Cl.
*B21B 1/46* (2006.01)
*B21B 45/00* (2006.01)
(Continued)

(52) U.S. Cl.
CPC ..... *C21D 9/50* (2013.01); *B21B 1/463* (2013.01); *B21B 45/004* (2013.01); *B24C 1/10* (2013.01);
(Continued)

(58) Field of Classification Search
CPC ..... C21D 9/50; C21D 1/42; C21D 8/0205; C21D 8/0226; C21D 8/0273;
(Continued)

(56) References Cited

U.S. PATENT DOCUMENTS 3,833,047 A 9/1974 Tovini

FOREIGN PATENT DOCUMENTS

CN 1141962 A 2/1997
CN 1714957 A 1/2006
(Continued)

*Primary Examiner* — Rebecca Janssen
(74) *Attorney, Agent, or Firm* — Rothwell, Figg, Ernst & Manbeck, P.C.

(57) ABSTRACT

The device and method for manufacturing metal clad strip continuously provided by the present invention, combines casting, rolling and heat treatment used for the single material manufacture with the continuous and large-scale manufacture method for the clad strip, greatly improves the productivity of clad strip. The present invention can be used for manufacturing single-sided or double-sided clad strips with different thickness specifications, wherein the base layer material or the clad layer material can be selected in a wide range, including carbon steel, stainless steel, special alloy steel, titanium, copper and the like. In the present
(Continued)

application, continuous casting and rolling clad strip is implemented, which decrease the energy consumption and costs.

15 Claims, 1 Drawing Sheet

(51) Int. Cl.

| | |
|---|---|
| ***B24C 1/10*** | (2006.01) |
| ***C21D 1/42*** | (2006.01) |
| ***C21D 8/02*** | (2006.01) |
| ***C21D 9/50*** | (2006.01) |
| ***C21D 9/00*** | (2006.01) |

(52) U.S. Cl.
CPC ..... *C21D 1/42* (2013.01); *C21D 8/0205* (2013.01); *C21D 8/0226* (2013.01); *C21D 8/0273* (2013.01); *C21D 9/0081* (2013.01)

(58) Field of Classification Search
CPC ..... C21D 9/0081; B21B 1/463; B21B 45/004; B24C 1/10; B22D 11/04; B22D 11/10; B22D 11/103; B22D 11/1206; B22D 11/225; B22D 11/008; B22D 11/041; B21C 37/02
See application file for complete search history.

(56) References Cited

FOREIGN PATENT DOCUMENTS

| | | | | | |
|---|---|---|---|---|---|
| CN | 1836800 | A | | 9/2006 | |
| CN | 101780532 | A | | 7/2010 | |
| CN | 102039309 | A | | 5/2011 | |
| CN | 103495618 | A | | 1/2014 | |
| CN | 103658178 | A | | 3/2014 | |
| CN | 104148598 | A | | 11/2014 | |
| CN | 104249135 | A | | 12/2014 | |
| CN | 104722577 | A | * | 6/2015 | |
| CN | 105215307 | A | | 1/2016 | |
| CN | 105290352 | A | | 2/2016 | |
| CN | 206632325 | U | | 11/2017 | |
| CN | 105290352 | B | * | 7/2018 | |
| EP | 3027330 | A1 | | 6/2016 | |
| JP | S61-49748 | A | | 3/1986 | |
| JP | S61-49749 | A | | 3/1986 | |
| JP | S61-115651 | A | | 6/1986 | |
| JP | S61-195741 | A | | 8/1986 | |
| JP | 2005-270997 | A | | 10/2005 | |
| KR | 10-2015-0063805 | A | | 6/2015 | |
| WO | 2015/014865 | A1 | | 2/2015 | |
| WO | WO-2015014865 | A1 | * | 2/2015 | ..... B21B 1/466 |
| WO | PCT/CN2019/071594 | | | 1/2019 | |

* cited by examiner

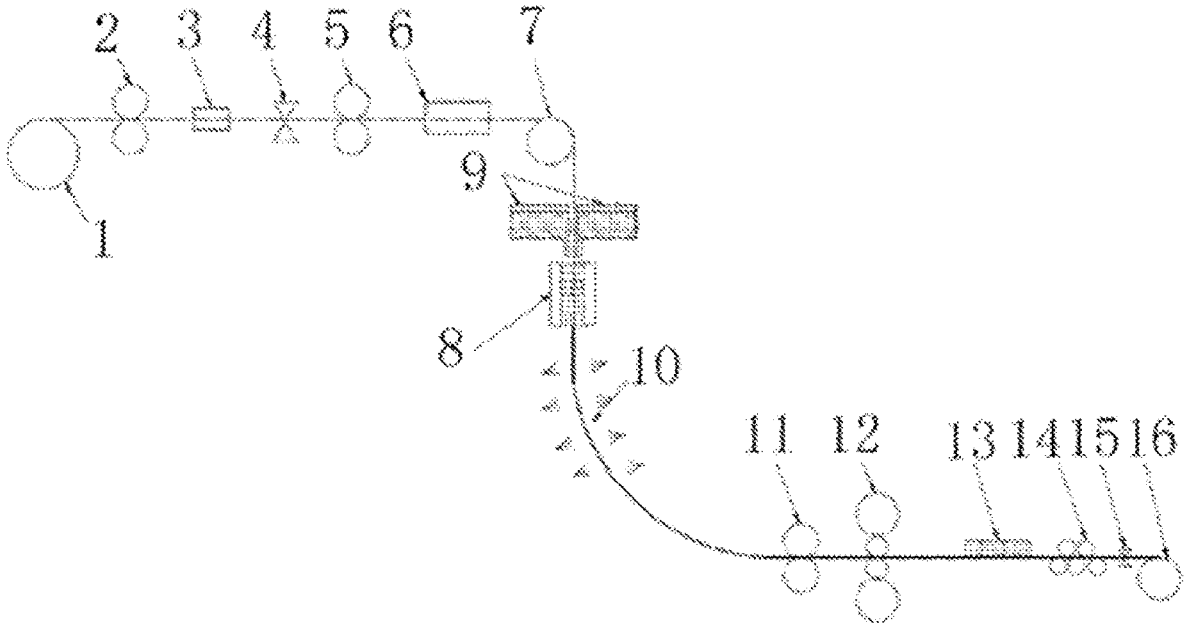
2
3
4
5
6
7
9
1
8
10
11
12
13
14
15
16

DEVICE AND METHOD FOR MANUFACTURING METAL CLAD STRIPS CONTINUOUSLY

TECHNICAL FIELD

The invention relates to steel metallurgical production, in particular to a device and method for manufacturing metal clad strips continuously, which can be used to produce metal clad strips with different materials component.

BACKGROUND ARTS

With the development of modern technology and national economy, customers have stricter requirements on the performance of materials. Since a single metal material can hardly satisfy the requirements for multiple performance in practical use, metal composite material that can provide both functional and structural performance arises, which plays an important role in meeting the customization and becomes more and more widely known and used by the customers. Some common methods and devices for manufacturing a metal clad strip are listed as below:

1. Explosive cladding: Clean up the contact surfaces of two different metal materials and add explosive into the interface between them. Though the instant high temperature caused by explosion is used to weld them together, lead to an insufficiently compound and low strength of the clad strips, which is only suitable for single sheet and small batch production;
2. Roll-bonded cladding: Clean up the surface of stainless steel and carbon steel for compounding, align them, and vacuumize the surrounding area and weld, then heat and roll to complete compound, which can achieve sufficient compound and high strength, but lead to low productivity, only suitable for single sheet and small batch production;
3. Centrifugal casted cladding: Feed the molten carbon steel and the molten stainless steel into the centrifuge sequentially. The molten carbon steel and the molten stainless steel are solidified successively to form annular clad plates and pipes which are then straightened, heated, rolled and their like.

At present, the ideal clad process is Roll-bonded cladding, the clad strip produced by which realizes complete metallurgical bonding at the interface, which has high bonding strength, and excellent product performance, but also causes the low efficiency of billet assembly which includes multiple processes, and difficult to realize continuously, automate and large-scale production, that increase the cost. In recent years, some processes and methods for manufacturing clad strips continuously have emerged, such as continuous casting and rolling, thin-strip continuous casting, etc. For example, CN1714957A discloses a method and equipment for manufacturing clad plates or strips for different metal materials, using 2~3 molds for molten carbon steel and molten stainless steel on a one continuous casting machine, to realize the continuous casting and rolling of single-sided or double-sided clad plates and strips, wherein the mold is composed of four synchronous moving steel strips respectively located at the top, bottom, left and right side of the mold, which change the former mold. The base layer metal and the clad layer metal all formed by solidification of the molten metal in the mold.

CN101780532A discloses a method for continuous casting of a molten-phase clad slab, which injecting the molten metal of base layer and the clad layer into a molten pool of roll mold formed by mold rolls and side seal plates, wherein the molten pool is divided into base layer cavity and clad layer cavity, and the clad strips is formed after Straightening and sizing of the strip formed in the mold. The disadvantage of this method is that both base layer and clad layer are form by the solidification of molten steel at the same time, which is difficult to control the clad interface, and not only need to keep two types of molten steel from mixing, but also need to ensure two materials will not be too cold to result in failure clad.

CN104249135A discloses a method for manufacturing the clad strips by double-roll thin strips, which feeding the intermediate strip to the molten pool of continuous casting double-roll thin strips, to solidify the molten metal rapidly under the cooling effect of both mold roll and intermediate strip, then form the single-sided or double-sided clad plates and strips. Similarly, CN103495618A discloses a device and method for manufacturing metal clad plates by casting and rolling, in which the method is to feed base material to be clad to the molten pool of a thin strip continuous casting machine, wherein the molten metal to be clad in the molten pool is solidified on the surface of the base material, and then the secondary cooling, leveling and rolling is carried out after the strip exiting the mold to form the clad strips. These two methods above are all based on thin strip continuous casting technique, the products prepared by which are mainly in specifications of thin strips, and the thickness of the solidified clad layer is limited, are not suitable for preparing thick clad layers strips.

CN102039309A discloses a method for continuous casting and rolling thin strip by composite-structure of double-roll and double-strip, in which two metal base material strips surround the mold roll to form a molten pool where the molten metal solidified and formed into a clad casting strip with the two metal base material strips, which is rolled by rolling mill to form a clad thin strip. The clad metal layer in this method is steel strips, and the base layer is solidified by molten steel.

CN105215307A discloses a process and equipment for manufacturing double-layer clad plates, the method of which is solidifying the different materials successively by using two tundishes and two molds. The casting slab solidified in the first mold enters the second mold, so that the second material can be adhere to the surface of the casting slab for solidification. Then, a single-sided clad plate is formed after secondary cooling, rolling and other procedure.

CN1141962A discloses a method for manufacturing clad strips continuously by reversal-fixation, in which the base material strip is decoiled, descaled and passivized, and preheated at a temperature range from 200° C. to 1000° C., then enters the mold pool to clad continuously with the molten metal in the pool.

The patents mentioned above are new techniques developed to improve the productivity of clad plates and realize continuous production, which also have some disadvantages respectively.

SUMMARY OF THE INVENTION

The present invention provides a device and method for manufacturing metal clad strips continuously, which improve the productivity of clad strips and reduce the manufacturing costs.

A device and method for manufacturing metal clad strips continuously according to the present invention, the device and specific steps are as follows:

A device for manufacturing metal clad strips continuously, comprising base material supplying equipment consisting of decoiler, pinch roll, shot blasting machine, welding equipment, welding pinch roll, induction heating apparatus, and guiding roll, wherein, base material strip are transported by the base material supplying equipment through decoiler, pinch roll, shot blasting machine, welding equipment, welding pinch roll, induction heating apparatus and guiding roll to the mold where the base material and molten steel are merged; the base material strip enters the mold along the middle inside from above, and pass through the mold from below, wherein the two inner walls of the mold being sealed with side seal plates; two tundishes for casting molten steel is provided above the mold; the molten steel flows from tundish into the mold and contact with the two sides of the base material strip in the mold, so that a preliminary melt merging takes place;

upon preliminary melt merging, the base material strip forms a clad slab which passes through the mold from below, and cooled at a secondary cooling section by cooling-spray located at the outlet of the lower part of the mold; a leveling roll is provided after the secondary cooling section, and a rolling mill is provided after the leveling roll for rolling the clad slabs into clad strips into different size and specification; an on-line cooling equipment for the clad strips is provided after the rolling mill, a straightening machine is provided at the exit of the on-line cooling equipment; the straightened clad strip is then cut to fixed length by a dividing shear or is coiled by a coiler.

A method for manufacturing metal clad plates in way of continuously by using the said device for manufacturing metal clad strips continuously, comprising the following steps:

1) decoiling base material strip having a thickness of 2-20 mm with decoiler, while sending base material strip having a thickness of 21~100 mm directly to the shot blasting machine through pinch roll for surface cleaning; then welding the shot-blasted base material strips head-to-tail by welding equipment so as to supply the base material strips continuously;

2) sending the welded base material strips through welding pinch roll to induction heating apparatus for heating, wherein the induction heating apparatus is filled with nitrogen or argon protection atmosphere, the heating temperature ranges from 100° C. to 1200° C., the heating rate ranges from 1~50° C./s depending on the thickness of the strip; the base material strips is selected from carbon steel, stainless steel, special alloy steel, titanium, copper and the like, the heating makes easier merging in the subsequent step of the base material strip and the molten clad layer, and accelerates melting of surface metal of base material strip;

3) sending the heated base material strips to mold through guiding roll, where the base material strips enters the mold along the middle inside from above and pass through the mold from below at a rate of 0.1~30 m/min; meanwhile, infusing one or two kind of molten clad melt in the tundish into the mold with argon blowing on the mold surface to prevent the molten clad melt from oxidation; the temperature of the molten clad melt is 30~150° C. higher than the melting point of the base material strips, and the molten clad melt is selected from carbon steel, stainless steel, special alloy steel, titanium, and copper; the molten clad melt having high temperature contacts the surface of the base material strip having low temperature, leading to slightly melt on the surface of the base material strip, and the molten clad melt is solidified on the surface of the base material strip having low temperature, so as to achieve a melting clad; with the molten clad melt being gradually solidified under the effect of the base material strip having low temperature and the copper plate of the mold, a clad slab is formed, wherein a single-sided clad slab can be formed by one tundish, and a double-sided clad slab can be formed by two tundishes;

4) the clad slab formed from the mold the passes through the mold from below and enters into secondary cooling section, where cooling water is sprayed on the upper and lower surfaces of the clad slab to further solidify the incompletely solidified composite slab, meanwhile the rapid cooling prevents the grains generated by surface solidification from growing and coarsening;

5) the clad slab after cooling is leveled by leveling roll and forwarded into rolling mill to be rolled into clad strip having different thickness ranging from 0.5 mm to 100 mm, where the clad interface of the clad strip is further compressed and deformed at high temperature during the rolling process, the microstructure of the clad interface structure recovers and recrystallizes, and recombination of the interface was promoted by grain growth and element diffusion under high temperature;

6) clad strip after rolling is on-line cooled by on-line cooling equipment according to the desired product performance, wherein the on-line cooling rate ranges from 1° C./s to 60° C./s, and the finish cooling temperature ranges from 50° C. to 600° C. depending on the thickness of the product;

7) the clad strip after above cooling is transported to straightening machine for straightening, which then cut in fixed length by dividing shear or coiled by a coiler.

The device and method for manufacturing metal clad strips continuously according to the present invention can produce the following effects:

1) The device and method for manufacturing metal clad strips continuously provided by the present invention, combines the continuous casting, rolling and heat treatment methods used for single material production with the continuous and large-scale production method used for clad strips, greatly improves the productivity of composite plates and strips;

2) The device and method for manufacturing metal clad strips continuously provided by the present invention, can be used to manufacture single-sided or double-sided clad strips of plates with different thickness specifications, wherein the base material or the clad material can be selected in a wide range, including carbon steel, stainless steel, special alloy steel, titanium, copper and the like;

3) The device and method for manufacturing metal clad strips continuously provided by the present invention, realizes continuous casting and rolling for clad strips and plates, and reduces energy consumption and costs.

FIGURE DESCRIPTION

The FIGURE shows a schematic diagram of the device and method for manufacturing metal continuously according to the present invention, in which:

1—decoiler, 2—pinch roll, 3—shot blasting machine, 4—welding equipment, 5—welding pinch roll, 6—induction heating apparatus, 7—guiding roll, 8—mold, 9—tundish, 10—secondary cooling section, 11—leveling roll, 12—rolling mill, 13—on-line cooling equipment, 14—straightening machine, 15—dividing shear, 16—coiler, A—base material strip, B—clad slab, C—clad strip.

DETAILED DESCRIPTION OF THE EMBODIMENTS

In the following, a device and method for manufacturing metal clad strips continuously provided by the present invention will be further described with reference to the drawings and embodiments.

Example 1: Double-Sided Clad Strips

1) Decoiling Q345B having a thickness of 20 mm with decoiler and sending it to shot blasting machine through pinch roll for surface cleaning, then welding the tail of shot-blasted strip to the head of the next shot-blasted strip by welding equipment so as to supply Q345B continuously;
2) The welded Q345B is transported through welding pinch roll to induction heating apparatus to be heated, wherein the induction heating apparatus is filled with nitrogen for protection, the heating temperature is 850° C., the heating speed is 10° C./s;
3) The heated Q345B passes through the mold along the middle inside of the mold at a speed of 3 m/min, and infusing the molten clad melt of 316L stainless steel in the two tundishes (9) into the mold with argon blowing on the mold surface to prevent the molten clad melt from oxidation, wherein the pouring temperature is 1550° C. The molten clad melt of 316L contacts the surface of the Q345B which surface is slightly melt, so as to achieve the primary melting clad of the clad layer and the base layer, and finally form a double-sided clad slab with a base layer of Q345B and clad layers of 316L, which has a thickness of 5+20+5 mm.
4) The double-sided clad slab formed in the mold passes through the mold and enters into secondary cooling section, where cooling water is sprayed on the upper and lower surfaces of the clad slab to further solidify the incompletely solidified clad material, meanwhile rapid cooling prevents the grains generated by surface solidification from growing and coarsening;
5) The cooled clad slab is transported to rolling mill at 1120° C. to be rolled into a double-sided clad strip with a thickness of 6 mm(1+4+1 mm), and the final rolling temperature is 1000° C. The rolled clad strip is cooled on-line, wherein the start cooling temperature is 950° C., the final cooling temperature is 540° C., and the cooling rate is 35° C./s;
6) The cooled clad strip is transported to straightening machine for straightening, and the straightened clad strip is coiled on-line by a coiler.

Example 2: Single-Sided Clad Strips

1) Decoiling AH36 carbon steel having a thickness of 40 mm with decoiler and sending it to shot blasting machine through pinch roll for surface cleaning, then welding the tail of shot-blasted strip to the head of the next shot-blasted strip by welding equipment so as to supply AH36 continuously;
2) The welded carbon steel is transported through welding pinch roll to induction heating apparatus to be heated, wherein the induction heating apparatus is filled with nitrogen for protection, the heating temperature is 900° C., the heating speed is 15° C./s;
3) The heated carbon steel passes through the mold along the middle inside of the mold at a speed of 1.8 m/min, and infusing the molten clad melt of 304L stainless steel in one of the tundishes into the mold with argon blowing on the mold surface to prevent the molten clad melt from oxidation, wherein the pouring temperature is 1580° C. The molten clad melt of 304L contacts the surface of the carbon steel which surface is slightly melt, so as to achieve the primary melting clad of the clad layer and the base layer, and finally form a single-sided clad slab with a base layer of AH36 carbon steel and clad layer of 304L, which has a thickness of 40+8 mm.
4) The single-sided clad slab formed in the mold passes through the mold and enters into secondary cooling section, where cooling water is sprayed on the upper and lower surfaces of the clad slab to further solidify the incompletely solidified clad material, meanwhile rapid cooling prevents the grains generated by surface solidification from growing and coarsening;
5) The cooled clad slab is transported to rolling mill at 1150° C. to be rolled into a single-sided clad strip with a thickness of 6 mm(5+1 mm), and the final rolling temperature is 970° C. The rolled clad strip is cooled on-line, wherein the start cooling temperature is 910° C., the final cooling temperature is 420° C., and the cooling rate is 40° C./s;
6) The cooled clad strip is transported to straightening machine for straightening, and the straightened clad strip is coiled on-line by a coiler.

The device and method for manufacturing metal clad strips continuously casting and rolling provided by the present invention, combines the continuous casting, rolling and heat treatment methods used for single material manufacture with the continuous and large-scale manufacture method of clad strip, greatly improves the productivity of clad strips and plates. The present invention can be used for manufacturing single-sided or double-sided clad plates and strips with different thickness specifications, wherein the base layer material or the clad material can be selected in a wide range, including carbon steel, stainless steel, special alloy steel, titanium, copper and the like. In the present application, continuous casting and rolling clad strip is implemented, which decrease the energy consumption and costs.

We claim:

1. A device comprising:

base material supplying equipment including a decoiler, a pinch roll, a shot blasting machine, a welding equipment, a welding pinch roll, an induction heating apparatus, and a guiding roll;

a mold, wherein the base material supplying equipment is configured to transport a base material strip through the decoiler, the pinch roll, the shot blasting machine, the welding equipment, the welding pinch roll, the induction heating apparatus, and the guiding roll to the mold, the mold is configured to merge the base material strip and molten steel, the base material strip enters the mold along a middle interior of the mold from above and passes through the mold, and two inner walls of the mold are sealed with side seal plates;

two tundishes configured to cast molten steel, wherein the two tundishes are provided above the mold, the molten steel flows from the two tundishes into the mold and makes contact with two sides of the base material strip in the mold so that a preliminary melt merging takes place in which the base material strip forms a clad slab that passes through the mold from below;

a secondary cooling section configured to cool the clad slab by a cooling-spray located at an outlet of a lower part of the mold;

a leveling roll provided after the secondary cooling section;

a rolling mill provided after the leveling roll and configured to roll the clad slab into a clad strip;

an on-line cooling equipment for the clad strip, wherein the on-line cooling equipment is provided after the rolling mill;

a straightening machine provided at an exit of the on-line cooling equipment and configured to straighten the clad strip; and a dividing sheer configured to cut the straightened clad strip to a fixed length or a coiler configured to coil the straightened clad strip.

2. A process comprising:

sending a base material strip through a pinch roll to a shot blasting machine for a surface cleaning;

welding the shot-blasted base material strips head-to-tail using a welding equipment so as to supply the base material strips continuously;

sending the welded base material strip through a welding pinch roll to an induction heating apparatus for heating;

sending the heated base material strip to a mold through a guiding roll, where the base material strip enters the mold along the middle interior of the mold from above and passes through the mold at a rate of 0.1~30 m/min;

infusing a molten clad melt in a tundish into the mold with argon blowing on a mold surface to prevent the molten clad melt from oxidation, wherein:

a temperature of the molten clad melt is 30~150° C. higher than a melting point of the base material strip, the molten clad melt, which has a high temperature, contacts a surface of the base material strip, which has a low temperature, leading to a slight melt on the surface of the base material strip, and the molten clad melt is solidified on the surface of the base material strip having the low temperature, so as to achieve a melting clad, the low temperature of the surface of the base material strip and a copper plate of the mold cause the molten clad melt to gradually solidify and form a clad slab;

passing the clad slab formed in the mold through the mold to a secondary cooling section, where cooling water is sprayed on an upper and a lower surface of the clad slab within the secondary cooling section to further solidify the clad slab;

leveling the clad slab after cooling by passing through a leveling roll and continuing into a rolling mill to be rolled into a clad strip, where a clad interface of the clad strip is compressed and deformed at a high temperature during the rolling process, a microstructure of a clad interface structure recovers and recrystallizes, and recombination of the interface promoted by a grain growth and an element diffusion under high temperature;

cooling the clad strip after rolling by on-line cooling equipment;

transporting the clad strip after above cooling to a straightening machine for straightening; and cutting the clad strip into a fixed length by a dividing shear or coiling the clad strip by a coiler.

3. The process of claim 2, wherein the clad slab is a single-sided clad slab.

4. The process of claim 2, further comprising infusing one or two kind of a molten clad melt in a second tundish into the mold, wherein the clad slab is a double-sided clad slab.

5. The process of claim 2, wherein the induction heating apparatus is filled with a nitrogen or an argon protection atmosphere.

6. The process of claim 2, wherein a heating temperature of the induction heating apparatus ranges from 850° C. to 1200° C., and a heating rate of the induction heating apparatus ranges from 1~50° C./s.

7. The process of claim 2, wherein the base material strips is selected from carbon steel, stainless steel, special alloy steel, titanium, or copper.

8. The process of claim 2, wherein the heating by the induction heating apparatus comprises merging the base material strip and a molten clad layer.

9. The process of claim 2, wherein the heating by the induction heating apparatus comprises accelerating melting of a surface metal of the base material strip.

10. The process of claim 2, wherein the molten clad melt is selected from carbon steel, stainless steel, special alloy steel, titanium, and copper.

11. The process of claim 2, wherein an on-line cooling rate of the on-line cooling equipment ranges from 1° C./s to 60° C./s, and a finish cooling temperature ranges from 50° C. to 600° C.

12. The process of claim 2, wherein the base material strip has a thickness of 2~20 mm.

13. The process of claim 12, further comprising decoiling the base material strip.

14. The process of claim 2, wherein the base material strip has a thickness of 21-100 mm.

15. The process of claim 14, wherein the base material strip is sent directly through the pinch roll to the shot blasting machine.

* * * * *